US008449274B1

(12) United States Patent
Zelechonok

(10) Patent No.: US 8,449,274 B1
(45) Date of Patent: May 28, 2013

(54) MAGNETIC RECIPROCATING PUMP

(75) Inventor: Yury Zelechonok, Northbrook, IL (US)

(73) Assignee: SIELC Technologies Corporation, Prospect Heights, IL (US)

( * ) Notice: Subject to any disclaimer, the term of this patent is extended or adjusted under 35 U.S.C. 154(b) by 270 days.

(21) Appl. No.: 13/045,360

(22) Filed: Mar. 10, 2011

(51) Int. Cl.
*F04B 17/04* (2006.01)

(52) U.S. Cl.
USPC ..... 417/417; 417/246; 417/265; 417/419; 417/488; 417/497

(58) Field of Classification Search
USPC ..... 417/246, 265, 418, 487, 488, 497, 417/534, 248, 249, 416, 417, 419; 92/248, 92/249
See application file for complete search history.

(56) References Cited

U.S. PATENT DOCUMENTS 2,293,684 A * 8/1942 Holthouse ..... 417/259
3,791,770 A * 2/1974 Farkos ..... 417/418
3,836,289 A * 9/1974 Wolford et al. ..... 417/417
4,437,815 A * 3/1984 McMullen ..... 417/418
4,541,787 A * 9/1985 DeLong ..... 417/417
5,472,323 A * 12/1995 Hirabayashi et al. ..... 417/417
6,015,270 A * 1/2000 Roth ..... 417/259
6,265,956 B1 7/2001 Cascolan et al.
6,504,699 B1 1/2003 Rader et al.
6,791,442 B1 9/2004 Schmidt
2008/0267798 A1 10/2008 Liu et al.

* cited by examiner

*Primary Examiner* — Devon Kramer
*Assistant Examiner* — Charles W Nichols
(74) *Attorney, Agent, or Firm* — John C. Shepard

(57) ABSTRACT

A magnetic reciprocating pump includes a tube having ends defining intake and discharge ports, first and second magnetic plungers axially aligned within the tube of corresponding cross section for reciprocation therewithin, and a plurality of longitudinally spaced coils circumscribing the tube for driving the plungers axially when electrically energized. A gap is defined between the plungers so that the first plunger is slidable between one tube end and the second plunger and the second plunger is slidable between the other tube end and the first plunger. The first plunger closes one port when moved thereagainst and has a peripheral flow path permitting flow when moved away. The second plunger closes the other port when moved thereagainst and has an outer peripheral flow path and a communicating inner axial flow path permitting flow when moved away. The plungers when moved together close the second plunger axial flow path.

17 Claims, 6 Drawing Sheets

MAGNETIC RECIPROCATING PUMP

BACKGROUND OF THE INVENTION

1. Technical Field

The present invention relates to a pump and, more particularly, to a reciprocating electromagnetic type pump.

2. Background Art

Typically, electrically driven reciprocating pumps include an electric motor, a motion translation means, and a pumping element of some kind. To make the motor work, a magnetic field is generated by the motor coils and this magnetic field creates tangential forces to turn the motor's rotor.

There have been many attempts in the past to eliminate the electric motor by applying magnetic forces to drive a pump plunger directly. Examples of these designs are shown in Hirabayashi et al. U.S. Pat. No. 5,472,323 issued Dec. 5, 1995 and Olson U.S. Pat. No. 7,288,085 issued Oct. 30, 2007. By employing such designs, many mechanical components can be eliminated from the pump system, including bearings, sliding seals, and rotors.

While having direct plunger drive capability, these past pump designs did not take full advantage of the direct magnetic drive. They were still complex mechanisms, they still required check valves to prevent backflow, and they were difficult to disassemble if they required cleaning or maintenance. Check valves are an especially troublesome component, since they have a tendency to leak or sometimes stick after a long idle period. In addition, check valves are usually not reversible, allowing fluid to flow in only one direction. In addition, the material from which check valves are constructed, namely, springs, balls, and the like, are incompatible with many fluids that are being moved through the pump.

While many of the prior art devices may be sufficient for their intended function, other constructions may provide features that may be more desirable to a user. It might be more advantageous to provide a pump that does not employ check valves or wearable seals, that is reversible, that is simple and easy to disassemble, that is made with materials compatible with the fluids being pumped, and that is scalable for use in small and large volume applications.

BRIEF SUMMARY OF THE INVENTION

The present invention is directed to overcoming one or more of the problems as set forth above.

It is a feature of the present invention to provide a pump that has a minimum of parts and may be easily disassembled to clean or repair and reassembled.

It is also a feature of the present invention to provide a pump having parts that have minimal physical and chemical interaction with fluids being pumped though it.

It is another feature of the present invention to provide a pump without check valves or springs.

It is yet another feature of the present invention to provide a pump that it is driven by means external of the fluid flow path.

It is a further feature of the present invention to provide a pump that is reversible and self-priming and can handle many different fluids, including liquids and gases.

It is a still further feature of the present invention to provide a pump that can be constructed in many different sizes and can deliver a predetermined measure of fluid.

It is yet a further feature of the present invention to provide a pump that does not require seals that reciprocate or rotate and wear by frictionally engaging an opposed surface.

In an exemplary embodiment of the present invention, a pump includes a tube with end caps defining a pump chamber with inlet and outlet ports, a pair of magnetic plungers separately slidable within the tube, and magnetic drive means to effect reciprocation of the plungers in the pump chamber.

In one aspect of the present invention, the plungers define a first work space when moved from one tube end, define a second work space when moved apart, and define a third work space when moved from the other tube end.

In another aspect of the present invention, the plungers are provided with radially arranged passageways so that the plungers selectively close communication of the pump chamber with the inlet and outlet ports and also selectively enable and disable flow fluid past the plungers themselves. As fluid flows longitudinally through the pump, the position of the plungers effects fluid flow alternately between the center and the periphery of the pump chamber.

In another aspect of the present invention, the end ports are closed by the ends of the plungers and the passageways include peripheral grooves on the sides of the plungers and a bore radially inward of the periphery of one plunger communicating with the grooves.

In still another aspect of the invention, the magnetic drive means includes coils circumscribing the tube that are energized with directionally selectable current or de-energized in programmed sequence to move the plungers to appropriate axial position within the tube to effect pumping of fluids in a selected direction.

BRIEF DESCRIPTION OF THE SEVERAL VIEWS OF THE DRAWING

The details of construction and operation of the invention are more fully described with reference to the accompanying drawings which form a part hereof and in which like reference numerals refer to like parts throughout.

In the drawings.

Figure 1:
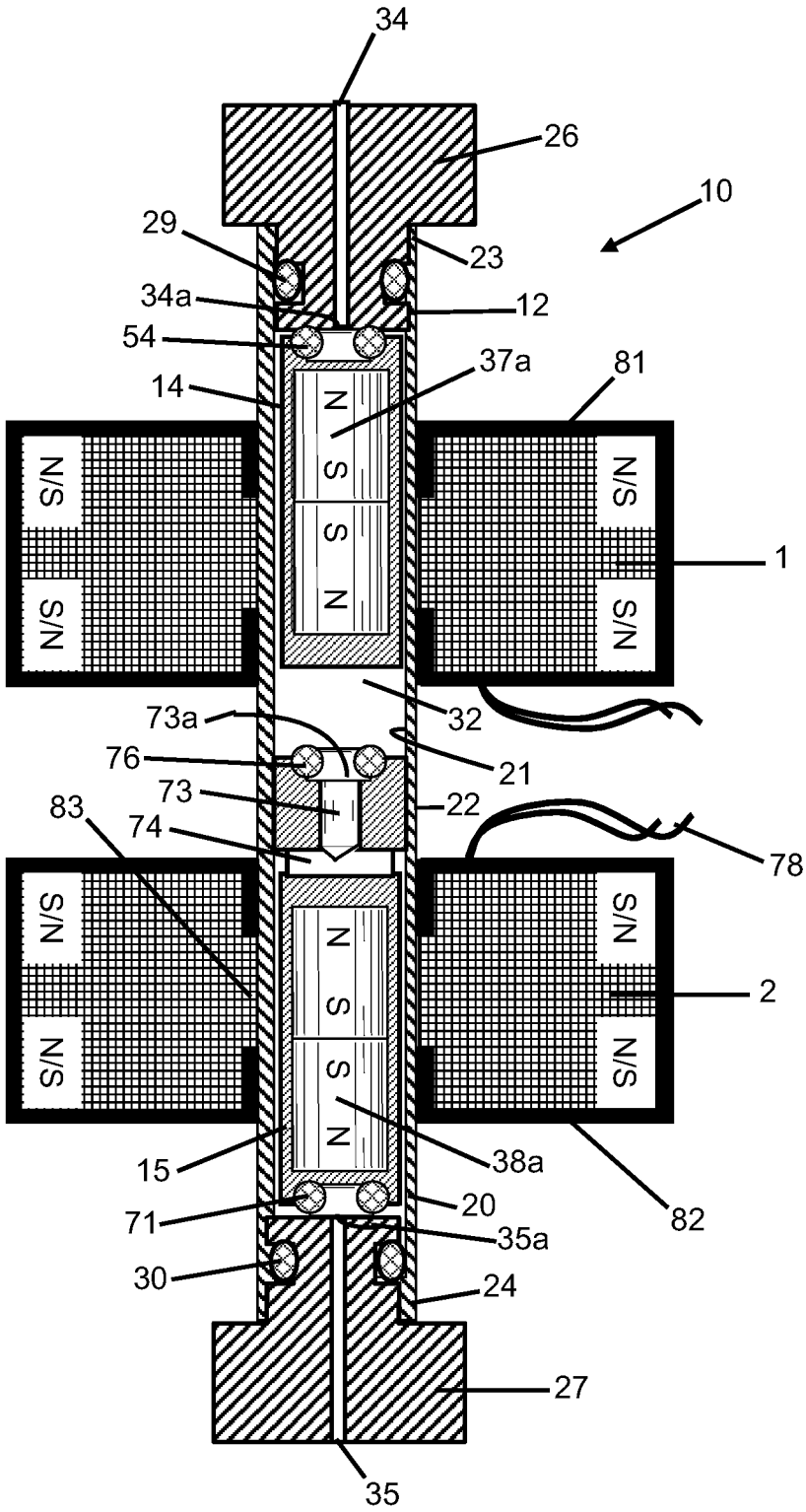
FIG. 1 is a cross-sectional view of an exemplary embodiment of a pump constructed in accordance with the present invention.

All figures are drawn for ease of explanation of the basic teachings of the present invention only; the extensions of the figures with respect to number, position, relationship, and dimensions of the parts to form the preferred embodiment will be explained or will be within the skill of the art after the following teachings of the present invention have been read and understood.

DETAILED DESCRIPTION OF THE INVENTION

While the present invention is susceptible of embodiment in many different forms, there are shown in the drawings and will be described herein in detail specific embodiments thereof with the understanding that the present disclosure is to be considered as an exemplification of the principles of the invention and is not intended to limit the invention to the specific embodiments illustrated.

Referring to the drawings in greater detail, FIG. 1 shows an exemplary embodiment of a magnetic reciprocating pump, generally designated 10, constructed in accordance with the teachings of the present invention. The magnetic pump is seen to include an elongate tube 12, a pair of sliding, generally cylindrical, magnetic armatures or plungers 14 and 15 positioned end-to-end within the tube 12, and a pair of coils 1 and 2.

The tube 12 includes a side wall 20 with a relatively smooth inner surface 21, an outer surface 22, and upper and lower ends 23 and 24. Upper and lower end caps 26 and 27 releasably secured by well-known means having respective O-ring seals 29 and 30 located in annular grooves (not numbered) close off each end of the tube 12 to define a constant diameter cylindrical internal pump chamber 32 extending along a longitudinal axis. Upper and lower ports 34 and 35 defined in the respective end caps 26 and 27 centered along the pump axis provide fluid communication to the tube exterior.

While the upper tube end 23 is described herein for convenience as a downstream end with an outlet discharge port 34 and the lower tube end 24 as an upstream end with an inlet intake port 35, it is understood that the pump described herein is bi-directional and that that upstream and downstream directions can be reversed such that the inlet becomes an outlet and an outlet becomes an inlet.

Each of the elongate plungers 14 and 15 respectively includes a pair of adjacent internal permanent magnets 37*a,b* and 38*a,b* enclosed by an outer layer of encapsulating material 40. The magnets 37*a,b* and 38*a,b* are preferably rare earth magnets and are positioned with their south (S) poles axially facing each other and their non-facing north (N) poles facing outward. It is noted that this face-to-face orientation of the south poles may be reversed to place the north poles face-to-face while maintaining functionality.

The plungers 14 and 15 have a cylindrical shape with an outer diameter corresponding to the inner diameter of the tube 12 so as to permit reciprocating sliding movement therein and to provide a relatively close fit between the tube 12 and the plungers 14 and 15. It is understood that the plungers 14 and 15 may spin or rotate freely about the longitudinal axis as they are reciprocated.

The tube 12 and encapsulating plunger layers 40 are both made from a durable, non-magnetic, chemically non-reactive and non-corrosive material with a relatively low co-efficient of friction. Preferably, the material is a high-density plastic, ceramic, glass, stainless steel, or the like, the material being selected to minimize friction, wear, pitting, corrosion, contamination, and the like.

The plungers 14 and 15 include passageways described hereafter that extend longitudinally in a radially inward center region or in a radially outward peripheral region. These passageways or flow paths permit fluid flow around or through the plungers 14 and 15 from one end to the other. Radial separation of the passageways allows communication between center and peripheral passageways to be closed when pump parts are moved into longitudinal contact with one another. For reasons that will be apparent, the peripheral regions should not overlap the center region even though the plungers may spin.

Figure 4A:
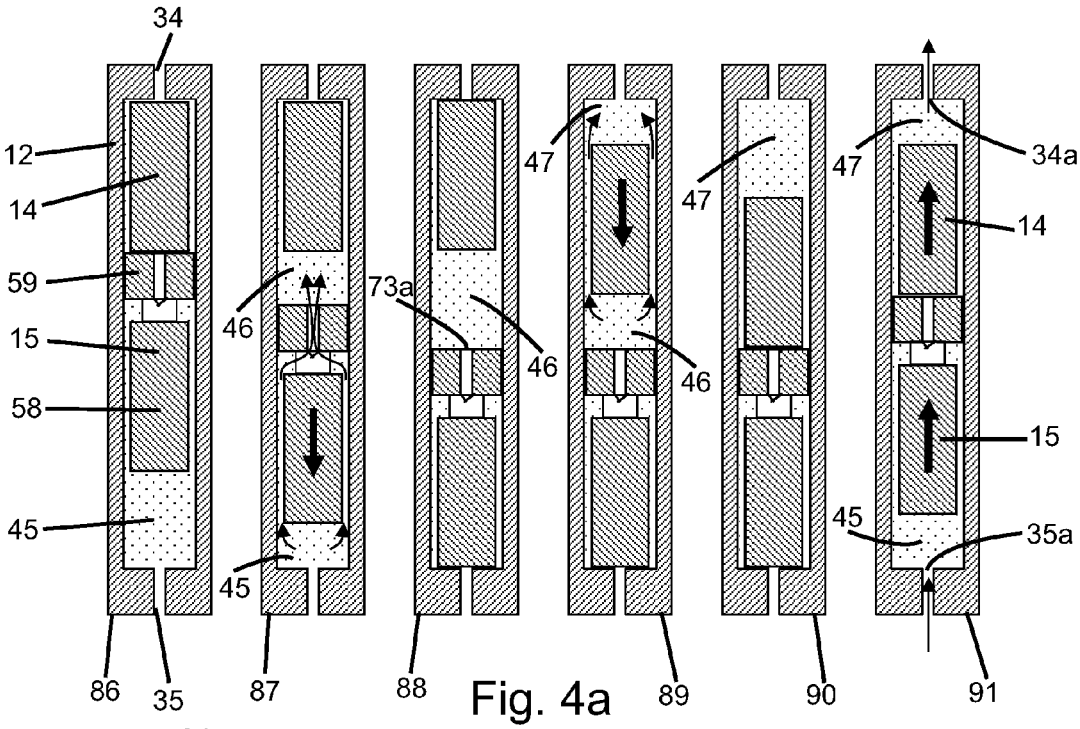
FIG. 4*a* is a diagram showing the operating stages of the pump shown in FIG. 1 when run in forward mode.
Figure 4B:
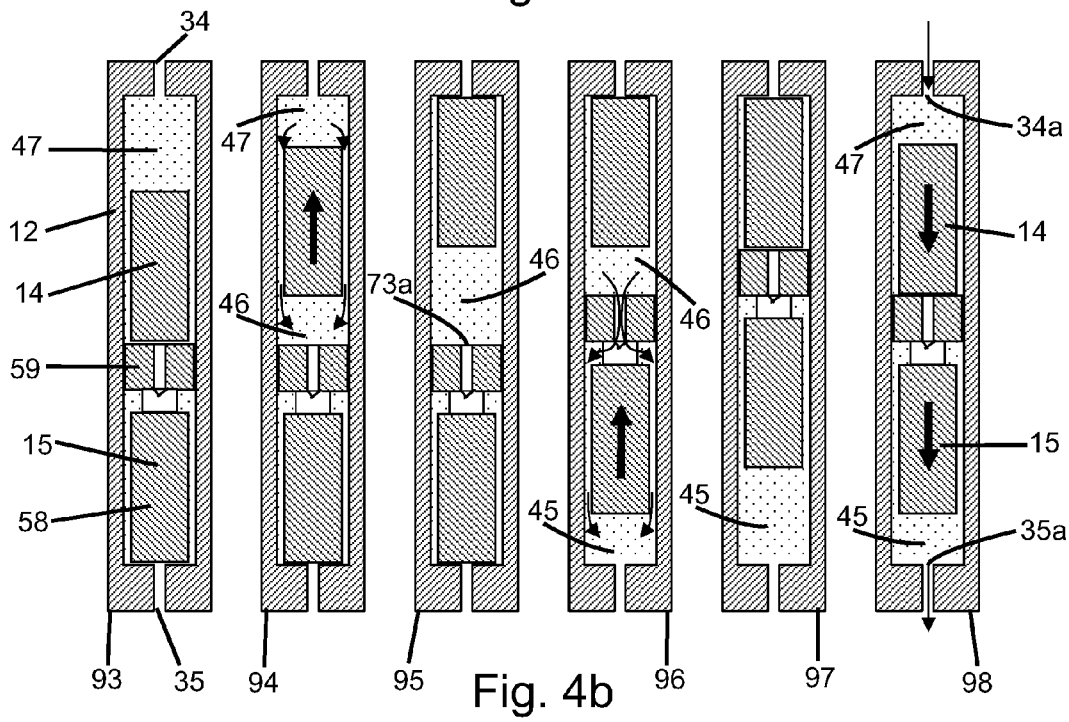
FIG. 4*b* is a diagram showing the operating stages of the pump shown in FIG. 1 when run in reverse mode.

Each of the reciprocating plungers 14 and 15 is movable to two discrete positions between their respective tube ends and the opposing end of the other plunger. The plungers 14 and 15 are separably slidable within the tube 12 and as seen in FIGS. 4*a* and 4*b* at various stages of operation, the plungers travel between three relative positions, namely, (1) both plungers 14 and 15 at an upper position to define a lower work space 45 wherein the upper port 34 is sealed from the pump chamber 32, (2) the plungers 14 and 15 separated with the upper plunger 14 at an upper position and the lower plunger 15 at a lower position to define an intermediate work space 46 wherein both ports 34 and 35 are sealed from the pump chamber 32, and (3) both plungers 14 and 15 at a lower position to define an upper work space 47 wherein the lower port 35 is sealed from the pump chamber 32. It can also be seen that when the plungers 14 and 15 are together, no fluid can move past the plungers 14 and 15 from one work space to another.

Figure 2A:
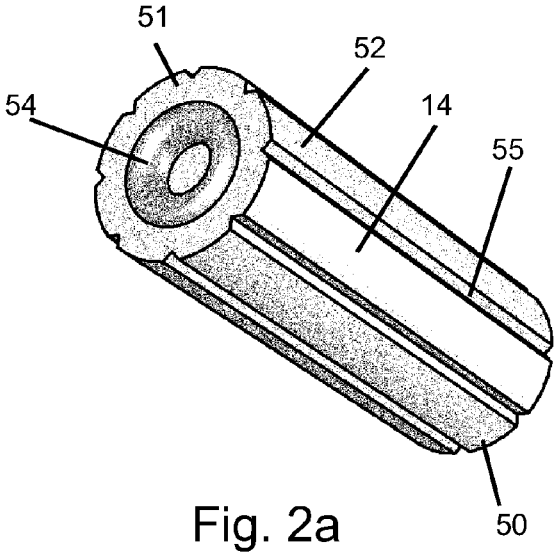
FIG. 2*a* is a perspective view of one of the plungers shown in FIG. 1.
Figure 2B:
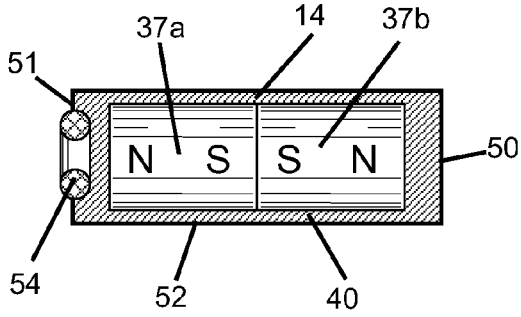
FIG. 2*b* is an enlarged cross-sectional view of the plunger shown in FIG. 2*a;*

As best seen in FIGS. 2*a* and 2*b*, the upper plunger 14 has longitudinally spaced inner and outer end surfaces 50 and 51 and a cylindrical side wall surface 52 extending therebetween. The outer end surface 51 carries an annular resilient element 54 within a circular cavity (not numbered) defined therein. The upper plunger 14 has a plurality of longitudinally extending, circumferentially spaced grooves, collectively numbered 55, defined in a peripheral region along its side surface 52 extending between its inner and outer end surfaces 50 and 51. The grooves 55 permit fluid flow between the side wall 52 and the tube side wall 20 past the upper plunger 14 to provide fluid communication between the upper port 34 and the space between the plungers 14 and 15. When the upper plunger 14 is moved axially outward against the upper end cap 26, the annular resilient element 54 closes off fluid communication between the upper port 34 and the upper work space 47 at port inner opening 34*a*.

Figure 3A:
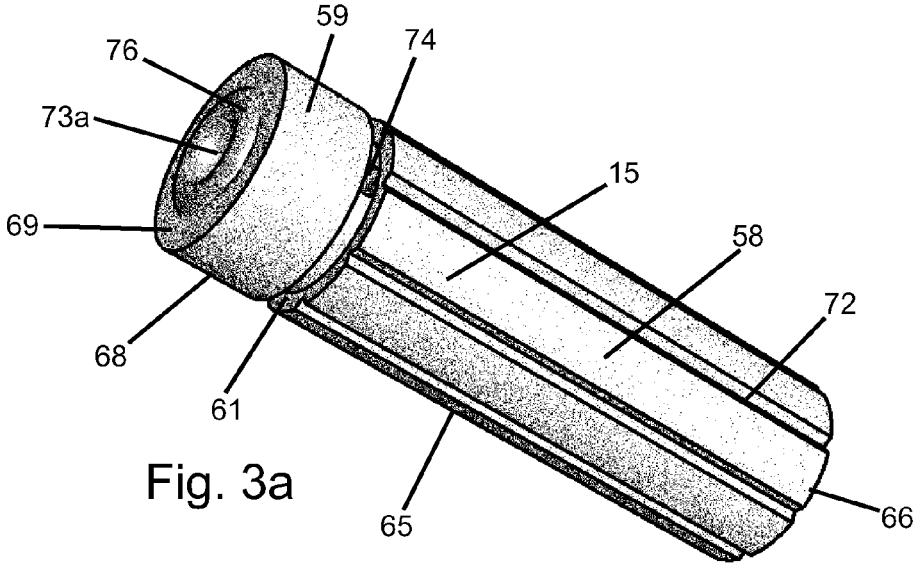
FIG. 3*a* is a perspective view of the other plunger shown in FIG. 1.
Figure 3B:
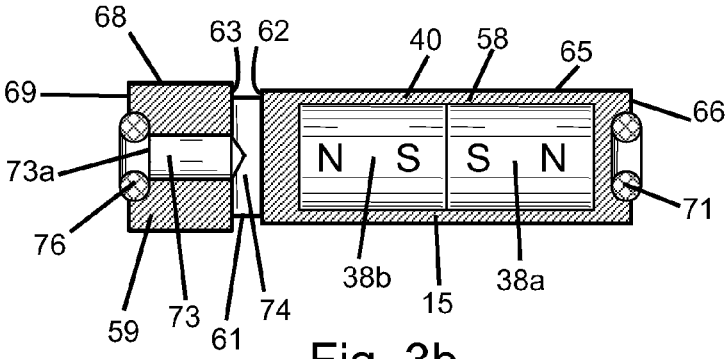
FIG. 3*b* is an enlarged cross-sectional view of the plunger shown in FIG. 3*a;*

As best seen in FIGS. 3*a* and 3*b*, the lower plunger 15 has outer and inner portions 58 and 59, respectively, separated by an annular circumferential groove 61 defined by spaced outer and inner shoulders 62 and 63. The outer portion 58 has a cylindrical side wall surface 65 extending from an outer end surface 66 to the outer shoulder 62 and has a longitudinal length similar to the length of the upper plunger 14. The inner portion 59 has a cylindrical side wall surface 68 extending from the inner shoulder 63 to an inner end surface 69 and has a length that is shorter than the outer portion 58. The outer portion 58 carries an annular resilient element 71 within a circular cavity (not numbered) defined in outer end surface 66 and has a plurality of longitudinally extending, circumferentially spaced grooves, collectively designated 72, defined in a peripheral region along its side wall 68 permitting fluid flow between its side wall 68 and the tube side wall 20 past the outer portion 58 to provide fluid communication between the lower port 35 and the annular groove 61. When the lower plunger 15 is moved axially outward against the lower end cap 27, the annular resilient element 71 closes off fluid communication between the lower port 35 and the lower work space 45 at port inner opening 35*a*.

An axial bore 73 extends from the center of the inner end surface 69 of the plunger inner portion 59 and communicates with a transverse bore 74 axially located between the shoulders 62 and 63 providing communication with the annular groove 61. The plunger inner portion 59 carries an annular resilient element 76 within a circular cavity (not numbered) defined in inner end surface 69 and when moved against the upper plunger 14 closes off fluid communication between the axial bore 73 and the intermediate work space 46 at bore inner opening 73*a*.

The axial flow paths 34, 35 and 73 are located within a center circular region on or near the longitudinal axis of the pump 10. The peripheral flow paths 55 and 72 are located within a peripheral region on or near the periphery of the plungers 14 and 15. The annular resilient elements 54, 71 and 76 are radially disposed within the boundary region between the center and peripheral regions to function as seals and close off fluid flow between axial and peripheral flow paths when adjacent parts are closed together. The annular resilient elements 54, 71 and 76, which may be made of rubber, soft plastic, or other suitable materials, also act as bumpers permitting moving plungers to stop quickly without excessive noise. It is understood that the plungers 14 and 15 are adapted to function as pistons and as valves closing the openings 34*a*, 35*a* and 73*a*.

While it is preferred that the axial passageways and ports be centered on the longitudinal axis and that the longitudinally extending peripheral grooves be located on the side surfaces of the plungers 14 and 15, it is understood that they need not be so located as long as a seal can be provided and maintained between axial and peripheral passageways even though there may be relative rotation of the parts about the longitudinal axis. Herein, the respective annular resilient elements surround the axial passageways 34, 35 and 73 and lie radially inward of the peripheral passageways 55 and 72 to effect separation of the axial and peripheral passageways when required.

The longitudinally spaced coils 1 and 2 circumscribe the outside of the tube 12 and are coaxial therewith. The coils 1 and 2 when energized establish a magnetic field within the tube chamber 32 to effect movement of the magnetic plungers 14 and 15 which are pulled into the coil's field, the direction of the applied current determining the polarity of the magnetic fields and, hence, the direction of axial pull. Each of the coils 1 and 2 is provided with leads 78 for connection to a suitable power source. The coils 1 and 2, have side walls 81 and 82, respectively, made of soft metallic material that shield the coils to focus magnetic flux in the coil gap 83 and the interior of the tube 12. After either magnetic plunger 14 or 15 has been pulled a plunger to either of its discrete positions, the plunger will remain in that position without any additional electrical current being applied due to the attraction of the permanent magnets latching with the respective metallic coil side walls 81 and 82.

Preferably, the width of the coil gap 83 should be less than half the length of the magnet pair 37*a,b* or 38*a,b* within the plungers. The stroke of the plungers, which is limited by the size of the empty work space, should be less than the width of the coil gap. Thus, the plungers do not move beyond the effect of the magnetic field that is established by the coils and each plunger can then be attracted to one side of its respective coil or the other.

Figure 5A:
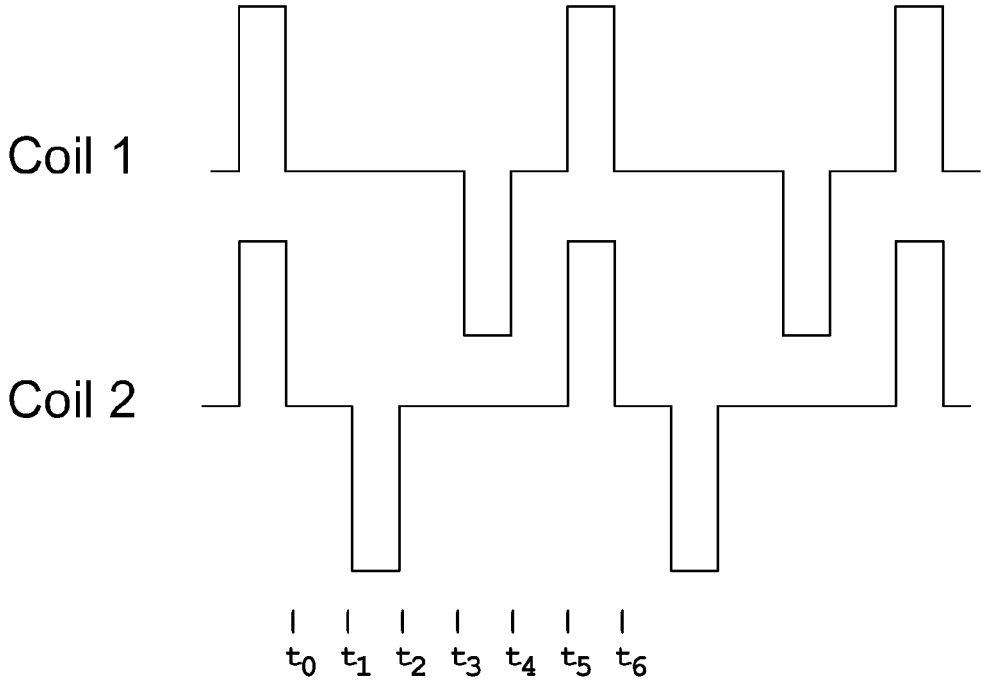
FIG. 5*a* is a timing diagram indicating current flow to the coils when the pump shown in FIG. 1 is run in forward mode for about 2 cycles.

Operation of the pump 10 in a forward mode is best understood by describing the operating positions shown in FIG. 4*a* in view of the timing diagram shown in FIG. 5*a*. Beginning with no drive current to the coils as indicated at time point $t_0$ in FIG. 5*a*, the upper and lower plungers 14 and 15 are at their upper positions with the lower plunger 15 up against the upper plunger 14. The fluid to be pumped from the lower port 35 is located in the lower work space 45 of the pump chamber 32 as seen at 86 in FIG. 4*a*.

At time point $t_1$, the lower coil 2 is negatively energized to drive the lower plunger 15 downward toward the lower end of the pump chamber 32. Downward movement of the lower plunger 15 forces fluid flow from the lower work space 45 upward around and through the lower plunger 15 into the intermediate work space 46 as indicated by the arrows at 87 in FIG. 4*a*.

At time point $t_2$, the lower coil 2 is de-energized with the lower plunger 15 at the lower end of the pump chamber 32 with the upper plunger 14 remaining at the upper end of the pump chamber 32. Fluid has been moved from the lower work space 45 upward into the intermediate work space 46 as seen at 88 in FIG. 4*a*.

At time point $t_3$, the upper coil 1 is negatively energized to drive the upper plunger 14 downward toward the lower plunger 15 with the lower plunger 15 remaining at the lower end of the pump chamber 32. Downward movement of the upper plunger 14 forces fluid flow from the intermediate work space 46 upward around the upper plunger 14 into the upper work space 47 as indicated by the arrows at 89 in FIG. 4*a*.

At time point $t_4$, the upper coil 1 is de-energized so that both upper and lower plungers 14 and 15 are at their lower positions with the upper plunger 14 against the lower plunger 15. Fluid has been moved from the intermediate work space 46 upward into the upper work space 47 as seen at 90 in FIG. 4*a*.

At time point $t_5$, the upper and lower coils 1 and 2 are positively energized to drive both upper and lower plungers 14 and 15 upwardly together toward the upper end of the pump chamber 32. Upward movement of the upper plunger 14 forces fluid from the upper work space 47 upward through the upper port 34 and upward movement of the lower plunger 15 draws fluid from the lower port 35 upward into the lower work space 45 as seen at 91 in FIG. 4*a*.

At time point $t_6$, the upper and lower coils 1 and 2 are de-energized with the upper and lower plungers 14 and 15 returned to their upper positions as they were at time point $t_0$, and the process is begun again to pump more fluid through the pump 10 from bottom to top.

Figure 5B:
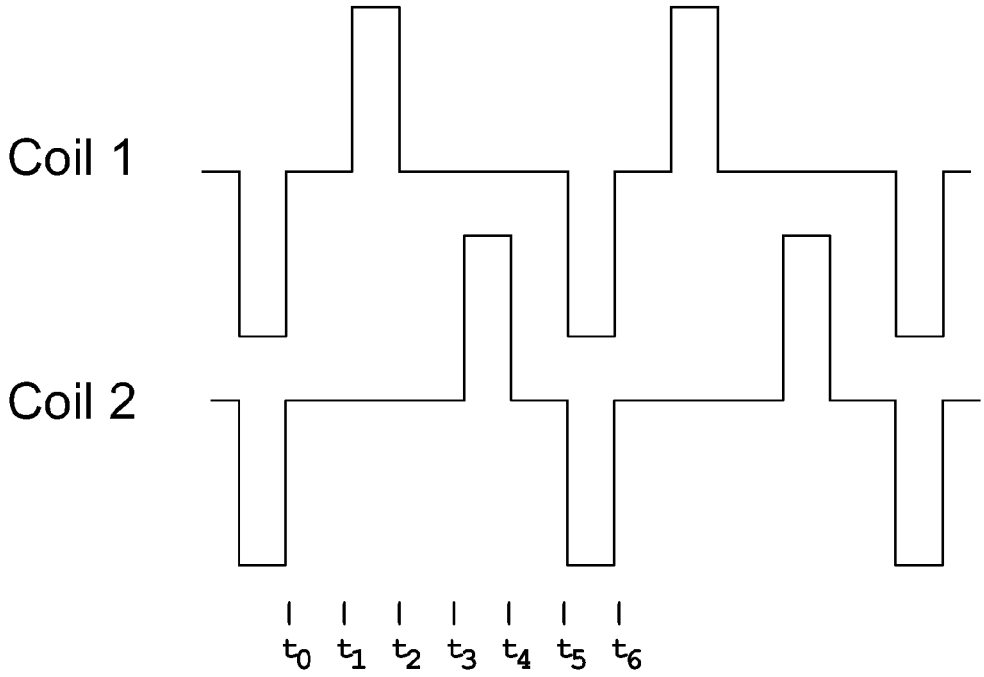
FIG. 5*b* is a timing diagram indicating current flow to the coils when the pump shown in FIG. 1 is run in reverse mode for about 2 cycles.

Operation of the pump 10 in a reverse mode is best understood by describing the operating positions shown in FIG. 4*b* in view of the timing diagram shown in FIG. 5*b*. Beginning with no drive current to the coils 1 and 2 as indicated at time point $t_0$ in FIG. 5*b*, the top and bottom plungers 14 and 15 are at their lower positions with the upper plunger 14 down against the lower plunger 15. The fluid to be pumped from the upper port 34 is located in the upper work space 47 of the pump chamber 32 as seen at 93 in FIG. 4*b*.

At time point $t_1$, the upper coil 1 is positively energized to drive the upper plunger 14 upward toward the upper end of the pump chamber 32. Upward movement of the upper plunger 32 forces fluid flow from the upper work space 47 downward around the upper plunger 14 into the intermediate work space 46 as indicated by the arrows at 94 in FIG. 4*b*.

At time point $t_2$, the upper coil 1 is de-energized with the upper plunger 14 at the upper end of the pump chamber 32 and the lower plunger 15 remaining at the lower end of the pump chamber 32. Fluid has been moved from the upper work space 47 downward into the intermediate work space 46 as seen at 95 in FIG. 4*b*.

At time point $t_3$, the lower coil 2 is positively energized to drive the lower plunger 15 upward toward the upper plunger 14. Upward movement of the lower plunger 15 forces fluid from the intermediate work space 46 downward through and around the lower plunger 15 into the lower work space 45 as seen by the arrows at 96 in FIG. 4*b*.

At time point $t_4$, the lower coil 2 is de-energized so that both upper and lower plungers 14 and 15 are at their upper positions with the lower plunger 15 against the upper plunger 14. Fluid has been moved from the intermediate work space 46 downward into the lower work space 45 as seen at 97 in FIG. 4*b*.

At time point $t_5$, the upper and lower coils 1 and 2 are negatively energized to drive both upper and lower plungers 14 and 15 downward together toward the lower end of the pump chamber 32. Downward movement of the lower plunger 15 forces fluid from the lower work space 45 downward through the lower port 35 and downward movement of the upper plunger 14 draws fluid from the upper port 34 downward into the upper work space 47 as seen at 98 in FIG. 4*b*.

At time point $t_6$, the upper and lower coils 1 and 2 are de-energized with the upper and lower plungers 14 and 15 returned to their lower positions as they were at time point $t_0$, and the process is begun again to pump more fluid through the pump 10 from top to bottom.

Figure 6:
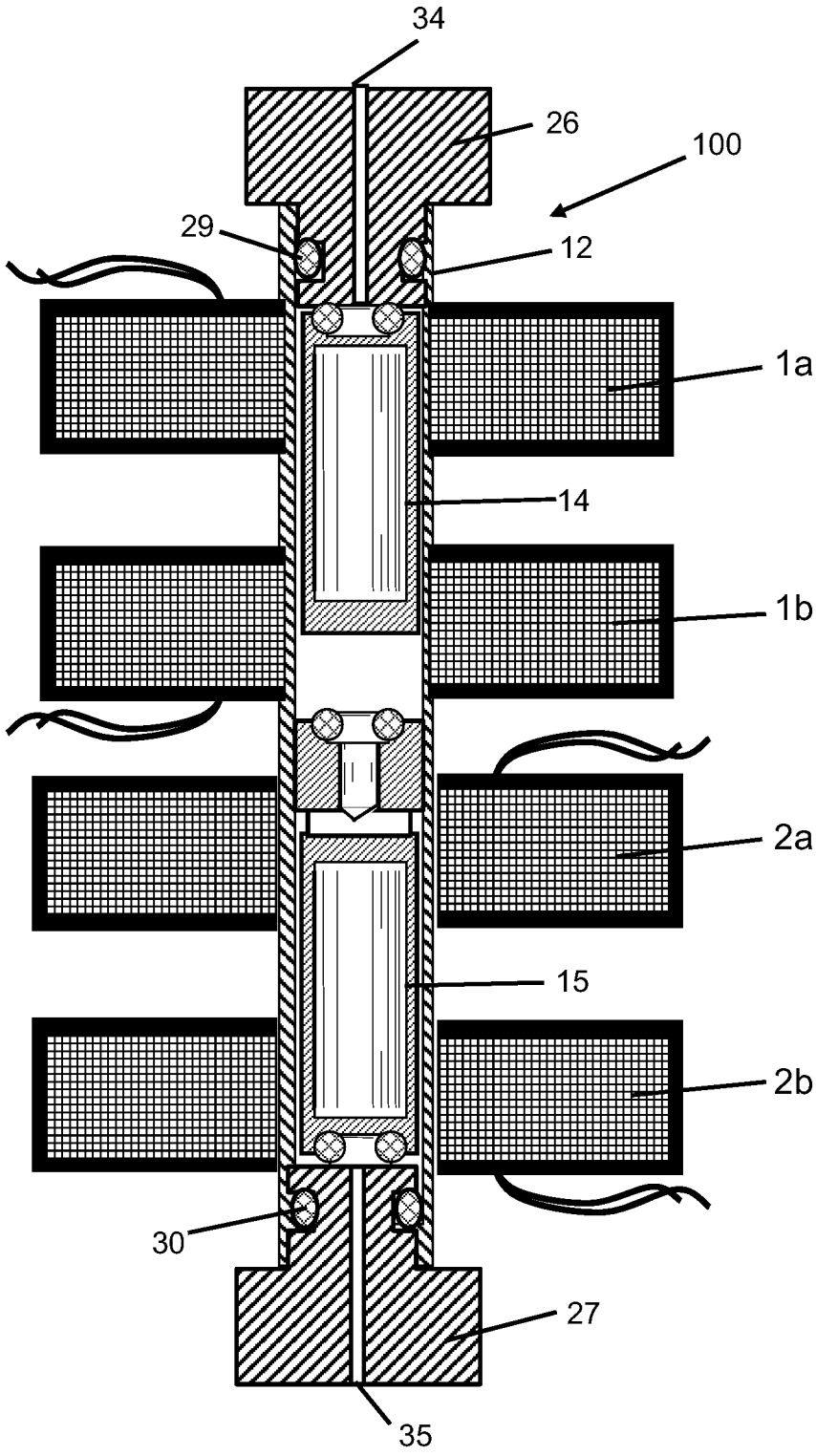
FIG. 6 is a cross-sectional view of another exemplary embodiment of a pump constructed in accordance with the present invention; and, FIG. 7 is a timing diagram indicating current flow to the coils when the pump shown in FIG. 6 is run in forward mode.

In another exemplary embodiment of the invention shown in FIG. 6, a magnetic reciprocating pump, generally designated 100, includes two pairs of coils 1*a*,1*b* and 2*a*,2*b* that are employed to move and hold the plungers 14 and 15 in discrete position. Herein, there is no requirement that the polarity of the electric current be reversed, only that current be turned off. Coils 1*a* and 1*b* making up the upper coil pair are positively energized one at a time to selectively pull the upper magnetic plunger 14 upward or downward. Similarly, coils 2*a* and 2*b* making up the lower coil pair are positively energized one at a time to selectively pull the lower magnetic plunger 15 upward or downward.

Figure 7:
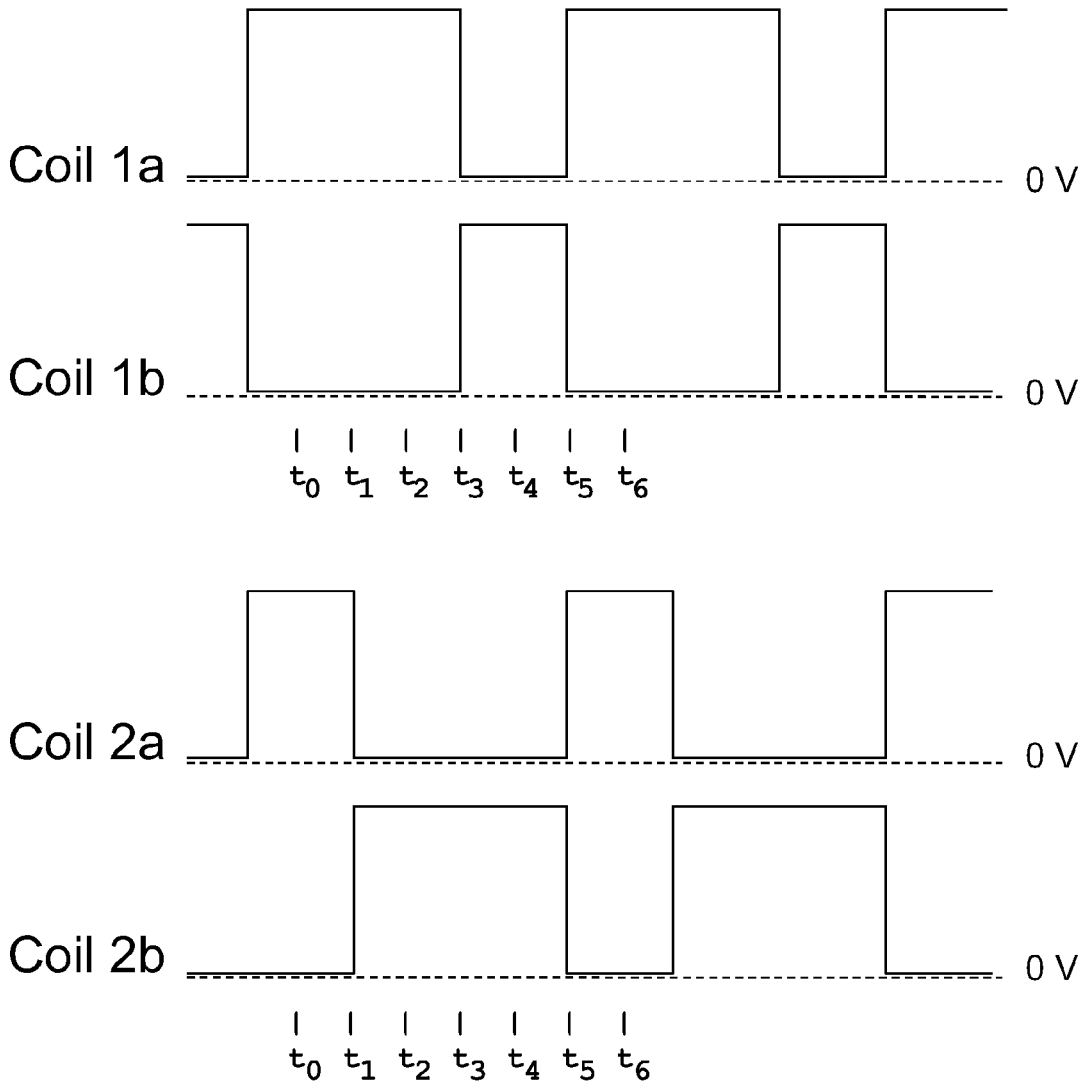

The operating stages of the pump embodiment shown in FIG. 6 in a forward mode is best described by viewing FIG. 4*a* in view of the timing diagram of FIG. 7. Beginning with time point $t_0$ in FIG. 7, coils 1*a* and 2*a* are energized and coils 1*b* and 2*b* are de-energized so that both upper and lower plungers 14 and 15 are at their upper positions with the lower plunger 15 up against the upper plunger 14. The fluid to be pumped from the lower port 35 is located within the lower work space 45 of the pump chamber 32 as seen at 86 in FIG. 4*a*.

At time point $t_1$, coil 2*a* is de-energized and coil 2*b* is energized to pull the lower plunger 15 downward toward the lower end of the pump chamber 32 with the upper plunger 14 remaining at the upper end of the pump chamber 32. Downward movement of the lower plunger 15 forces fluid flow from the lower work space 45 upward around and through the lower plunger 15 into the immediate work space 46 as indicated by the arrows at 87 in FIG. 4*a*.

At time point $t_2$, coils 1*b* and 2*a* remain de-energized and coils 1*a* and 2*b* remain energized holding the plungers 14 and 15 in fully spaced relation, each at their respective ends of the pump chamber 32. Fluid has been moved from the lower work space 45 upward into the intermediate work space 46 as seen at 88 in FIG. 4*a*.

At time point $t_3$, coil 1*a* is de-energized and coil 1*b* is energized to pull the upper plunger 14 downward toward the lower plunger 15 with the lower plunger 15 remaining at the lower end of the pump chamber 32. Downward movement of the upper plunger 14 forces fluid flow from the intermediate work space 46 upward around the upper plunger 14 into the upper work space 47 as indicated by the arrows at 89 in FIG. 4*a*.

At time point $t_4$, coils 1*b* and 2*b* remain energized and coils 1*a* and 2*a* remain de-energized so that both upper and lower plungers 14 and 15 are at their lower positions with the upper plunger 14 against the lower plunger 15. Fluid has been moved from the intermediate work space 46 upward into the upper work space 47 as seen at 90 in FIG. 4*a*.

At time point $t_5$, coils 1*b* and 2*b* are de-energized and coils 1*a* and 2*a* are energized to pull the upper and lower plungers 14 and 15 upward together toward the upper end of the pump chamber 32. Upward movement of the upper plunger 14 forces fluid from the upper work space 47 upward through the upper port 34 and upward movement of the lower plunger 15 draws fluid from the lower port 35 upward into the lower work space 45 as seen at 91 in FIG. 4*a*.

At time point $t_6$, coils 1*a* and 2*a* remain energized with the upper and lower plungers 14 and 15 returned to their upper positions as they were at time point $t_0$, and the process is begun again to pump more fluid through the pump 10 from bottom to top.

Technical Use

In the pump embodiment shown herein, the plungers have an outside diameter of about ¼ inch and are moved through a complete pumping operation at a rate of about 1/10 to 10 cycles per second. Because the pump has a fixed stroke, the pumping of fluids can be controlled to obtain measured volumes. The magnetic pump described herein can be used advantageously in laboratory applications, but its size can be scaled upwardly or downwardly for any particular application. For any given pump, the operating speed can be easily modified by adjusting the cycle time and the pump pressure can be modified by changing the cycle volume or the number of windings in the coil.

INDUSTRIAL APPLICABILITY

It should be apparent the pump described herein is a simple, functional unit that is effective and easily constructed and operated.

Other aspects, objects and advantages of this invention can be obtained from a study of the drawings, the disclosure and the appended claims.

It should be understood that the terms "top," "bottom," "front," "back," "forward," "rear," "first," "second," "upper," "lower," "height," "width," "length," "end," "side," "horizontal," "vertical," and similar terms as used herein, have reference only to the structure shown in the drawings and are utilized only to facilitate describing the invention. The terms and expressions employed herein have been used as terms of description and not of limitation.

From the foregoing, it will be observed that numerous variations and modifications may be effected without departing from the spirit and scope of the invention. It is to be understood that no limitation with respect to the specific apparatus illustrated herein is intended or should be inferred. While specific embodiments of the invention have been disclosed, one of ordinary skill in the art will recognize that one can modify the dimensions and particulars of the embodiments without straying from the inventive concept.

What is claimed is:

1. A magnetic reciprocating pump, comprising:

a tube having a cylindrical side wall closed by first and second ends to define a cylindrical internal chamber extending along a longitudinal axis, said tube ends respectively defining first and second ports communicating with said chamber;

first and second elongate plungers reciprocatable within said chamber and including a side wall extending between inner and outer ends, each plunger carrying a magnet having longitudinally spaced poles, said first plunger movable between said first tube end and said second plunger, said second plunger being movable between said first plunger and said second tube end;

said first plunger when moved from said first tube end defining therewith a first work space within said chamber, said plungers when moved apart defining therebetween a second work space within said chamber, said second plunger when moved from said second tube end defining therewith a third work space within said chamber;

said first plunger defining a first flow path providing fluid communication between said first and second spaces;

said second plunger defining a second flow path providing fluid communication between said second and third spaces;

said first plunger having its outer end adapted to block said first port when moved to said first tube end, said second plunger having its outer end adapted to block said second port when moved to said second tube end, said first plunger having its inner end adapted to block said second flow path when said plungers are moved together; and, means for selectively applying a magnetic field to said plungers to effect longitudinal movement of said plungers within said tube and selectively position said plungers relative to the tube ends and to each other, whereby movement of said first plunger to said first tube end stops fluid flow through said first port, movement of said second plunger to said second tube end stops fluid flow through said second port, and movement of said plungers together stops fluid flow past said plungers.

2. The pump of claim 1 wherein said first flow path comprises at least one longitudinal groove defined in said first plunger side wall.

3. The pump of claim 1 wherein said second flow path comprises an annular groove circumferentially defined in the side wall of the second plunger intermediate its inner and outer ends, at least one longitudinal groove defined in said second plunger side wall extending between said second plunger outer end and said annular groove, and a center passageway extending between said annular groove and the center of said second plunger inner end.

4. The pump of claim 3 further including a first resilient element on the outer end of the first plunger adapted to surround said first port, a second resilient element on the outer end of the second plunger adapted to surround said second port, and a third resilient element carried by one of said plungers adapted to surround said second plunger passageway.

5. The pump of claim 1 wherein said means for selectively applying a magnetic field is a plurality of coils circumscribing and longitudinally spaced along said tube with electric current being selectively passed through said coils.

6. The pump of claim 5 wherein there are two coils, one of said coils being operative to move a respective one of said plungers towards either end of said tube by selectively changing the direction of current passing through said coils.

7. The pump of claim 5 wherein there are two pairs of coils longitudinally spaced on the tube, each pair of coils being operative to move one of said plungers towards either end of said tube by selectively passing current through one coil of the pair.

8. The pump of claim 1 wherein each of said plungers includes a pair of magnets carried end-to-end with the pole of one magnet being located axially face-to-face with the like pole of the other magnet in the magnet pair.

9. The pump of claim 8 wherein said means for selectively applying a magnetic field comprises a plurality of coils circumscribing and longitudinally spaced along said tube with electric current being selectively passed through said coils, each of said coils defining an internal coil gap of predetermined width, and said coil gap being less than one-half the length of a magnet pair.

10. A magnetic reciprocating pump, comprising:

a tube having a cylindrical side wall closed by first and second ends to define a cylindrical internal chamber extending along a longitudinal axis, said tube ends respectively defining first and second ports communicating with said chamber;

first and second elongate plungers reciprocatable within said chamber and including a side wall extending between inner and outer ends, each plunger carrying a magnet having longitudinally spaced poles, said first plunger movable between said first tube end and said second plunger, said second plunger being movable between said first plunger and said second tube end;

said first plunger when moved from said first tube end defining therewith a first work space within said chamber, said plungers when moved apart defining therebetween a second work space within said chamber, said second plunger when moved from said second tube end defining therewith a third work space within said chamber;

said first plunger having at least one longitudinal groove defined in its side wall providing fluid communication between said first and second spaces;

said second plunger having an annular groove circumferentially defined in its side wall intermediate its inner and outer ends, at least one longitudinal groove defined in said second plunger side wall extending between its outer end and said annular groove, and a passageway extending between said annular groove and the center of its inner end, together providing fluid communication between said second and third spaces;

said first plunger having its outer end adapted to block said first port when moved to said first tube end, said second plunger having its outer end adapted to block said second port when moved to said second tube end, said first plunger having its inner end adapted to block said passageway when said plungers are moved together; and, means for selectively applying a magnetic field to said plungers to effect longitudinal movement of said plungers within said tube and selectively position said plungers relative to the tube ends and to each other, whereby movement of said first plunger to said first tube end stops fluid flow through said first port, movement of said second plunger to said second tube end stops fluid flow through said second port, and movement of said plungers together stops fluid flow past said plungers.

11. The pump of claim 10 further including a first resilient element on the outer end of the first plunger adapted to surround said first port, a second resilient element on the outer end of the second plunger adapted to surround said second port, and a third resilient element carried by one of said plungers adapted to surround said second plunger passageway.

12. The pump of claim 10 wherein said means for selectively applying a magnetic field is a plurality of coils circumscribing and longitudinally spaced along said tube with electric current being selectively passed through said coils.

13. The pump of claim 12 wherein there are two coils, one of said coils being operative to move a respective one of said plungers towards either end of said tube by selectively changing the direction of current passing through said coils.

14. The pump of claim 12 wherein there are two pairs of coils longitudinally spaced on the tube, each pair of coils being operative to move a respective one of said plungers towards either end of said tube by selectively passing current through one coil of the respective pair.

15. The pump of claim 10 wherein each of said plungers includes a pair of magnets carried end-to-end with the pole of one magnet being located axially face-to-face with the like pole of the other magnet in the magnet pair.

16. The pump of claim 15 wherein said means for selectively applying a magnetic field comprises a plurality of coils circumscribing and longitudinally spaced along said tube with electric current being selectively passed through said coils, each of said coils defining an internal coil gap of predetermined width, and said coil gap being less than one-half the length of a magnet pair.

17. A magnetic reciprocating pump, comprising:

a tube having a cylindrical side wall closed by first and second ends to define a cylindrical internal chamber extending along a longitudinal axis, said tube ends respectively defining first and second ports communicating with said chamber;

first and second elongate plungers reciprocatable within said chamber and including a side wall extending between inner and outer ends, each plunger carrying a magnet having longitudinally spaced poles, said first plunger movable between said first tube end and said second plunger, said second plunger being movable between said first plunger and said second tube end;

said first plunger when moved from said first tube end defining therewith a first work space within said chamber, said plungers when moved apart defining therebetween a second work space within said chamber, said second plunger when moved from said second tube end defining therewith a third work space within said chamber;

said first plunger having at least one longitudinal groove defined in its side wall providing fluid communication between said first and second spaces;

said second plunger having an annular groove circumferentially defined in its side wall intermediate its inner and outer ends, at least one longitudinal groove defined in said second plunger side wall extending between its outer end and said annular groove, and a passageway extending between said annular groove and the center of its inner end, together providing fluid communication between said second and third spaces;

a first resilient element adapted to surround said first port and block fluid flow therethrough when said first plunger is moved to said first tube end;

a second resilient element adapted to surround said second port and block fluid flow therethrough when said said plunger is moved to said second tube end;

a third resilient element carried by one of said plungers adapted to surround said second plunger passageway and block fluid flow therethrough when said plungers are moved together; and, said first plunger having its outer end adapted to block said first port when moved to said first tube end, said second plunger having its outer end adapted to block said second port when moved to said second tube end, said first plunger having its inner end adapted to block said passageway when said plungers are moved together; and, a plurality of coils circumscribing and longitudinally spaced along said tube with electric current being selectively passed through said coils to establish a magnetic field within said chamber and effect longitudinal movement of said plungers within said tube and selectively position said plungers relative to the tube ends and to each other, whereby movement of said first plunger to said first tube end stops fluid flow through said first port, movement of said second plunger to said second tube end stops fluid flow through said second port, and movement of said plungers together stops fluid flow past said plungers.

* * * * *